United States Patent [19]

Paul et al.

[11] 4,444,293

[45] Apr. 24, 1984

[54] SAFETY ARRESTER FOR MINE-SHAFT CONVEYANCES USING TUBING GUIDES

[75] Inventors: Willard S. Paul, Lakewood; Gary K. Christian, Littleton, both of Colo.

[73] Assignee: Card Corporation, Denver, Colo.

[21] Appl. No.: 289,186

[22] Filed: Aug. 3, 1981

[51] Int. Cl.[3] ..... B66B 5/18

[52] U.S. Cl. ..... 187/87; 187/88; 187/81; 187/86

[58] Field of Search ..... 187/87, 80, 81, 72, 187/73, 86; 188/188, 189, 136

[56] References Cited

U.S. PATENT DOCUMENTS

| | | | |
|---|---|---|---|
| 124,592 | 3/1872 | Klee | 187/87 |
| 2,507,046 | 5/1950 | Pearce | 187/87 |
| 2,561,060 | 7/1951 | Lancaster | 187/87 |

*Primary Examiner*—Joseph J. Rollo
*Assistant Examiner*—Thomas C. Fitzgerald

[57] ABSTRACT

A safety arrester for mine shaft passenger cages is provided wherein a pair of arresting cams are arranged to straddle the sides of a tubing guide positioned on each side of the mine shaft which tubing guide is used for stabilizing the movement of the cage. If the lifting cable should fail, a spring biased actuation mechanism will move causing the arresting cams to move into contact with the guide. As the cage is falling, the arresting cams act on the surfaces of the tubing guides to deform these surfaces. Also, the surface of the arresting cam comprises a deformable material so that, as the cage is falling, more and more of the surface of the arresting cam comes into contact with the surface of the tubing guide. Thus, the falling cage is gradually brought to a safe stop.

11 Claims, 13 Drawing Figures

2
30
26
36
38
10
82
32
34
70
16
68
40
64
66
5
84
22
42
4
3
112
52
20
120
98
116
122
120
126
105
108
56
58
5
104
3
92
90
60
96
96
62
92
14
88
2
24
12
102
18
14
102

30
38
26
28
22
82
48
86
46
50
44
98
104
92
88
94
102
104
102
24

56
14
114
124
112
16
122
56

40
46
48
54
44
120
106
52
120
112
123
105
114
50
123
96
92
94
96

SAFETY ARRESTER FOR MINE-SHAFT CONVEYANCES USING TUBING GUIDES

BACKGROUND OF THE INVENTION

This invention is directed to a safety device for arresting the falling motion of a cage or skip in a mine shaft environment. It is more specifically directed to an opposing cam-type safety brake which is used in conjunction with tubing guides for stopping the sudden free fall motion of the cage or skip conveyance.

In the past it has been common to apply various types of safety brake devices to conveyances which have been utilized in mine shafts for many years. In some of those cases, the brake or arrester devices have utilized cutting teeth for use with wood guides.

In one known case a gear rack is provided longitudinally in the mine shaft in which the hoist cage operates. A pair of gears extending on shafts through each side of the cage engages with the rack and provides a braking device on the gear shaft so that if the hoisting cable should break or other malfunction occur the braking device on the shaft would immediately seize arresting any falling motion of the hoist cage.

In another instance it has been known to arrange outwardly settable pins in conjunction with the hoist cage so that if the hoist cable should break the pins would automatically engage openings or slots in stationary rails on the side of the shaft so that the cage will be locked in place automatically. Other types of arresting devices provide clamping blocks which have a high friction material on the surface of the blocks so that the blocks will move outwardly against a stationary surface such as the walls of the shaft or safety guides provided vertically along the sides of the shaft.

Still other safety arrangements provide additional safety cables and support devices to attempt to arrest and control any sudden downward or falling motion of the cage in order to protect and save any passengers or equipment which may be inside.

The safety devices which have been described above are rather rudimentary and crude with respect to safely arresting the falling motion of a mine passenger cage. In many mine situations these devices cause a sudden, violent stopping motion which when used in conjunction with human passengers can cause considerable injury to these passengers. The primary consideration in a mine shaft environment has been the arresting or sudden stopping of the falling motion of the cage with little regard given to the actual welfare of the passengers as well as the surrounding structure or those persons who may be in the vicinity of the falling cage. Due to the weight of the cage which is used in mine shafts not only for the movement of passengers but also freight and products of the mining operation, the cage must be extremely strong and heavy. This necessitates a rather bulky structural integrity with little regard for the comfort or protection of human passengers. Thus, a high gravitational pull could be applied to the human passengers upon the actuation of the arresting devices which have been utilized in the past.

To overcome these problems and yet safely stop the falling motion of a passenger cage, it is an object of the present invention to provide an absolute foolproof device which can smoothly decelerate and safely stop the falling motion of a passenger cage without causing injury to the passengers.

It is a still further object of the present invention to provide a mine shaft passenger safety arrester which can positively stop the falling motion of the cage under and adverse environmental condition which can be experienced in a mine shaft operation.

It is a further object of the present invention to provide a safety arrester for a mine shaft passenger cage in which the arrester will absolutely stop the falling motion of the cage in a relatively progressive operation which will provide only a reasonable deacceleration force to the passengers to prevent injury.

It is another object of the present invention to provide an arresting device for mine shaft passenger cage which utilize a pair of tube guides in controlling the horizontal motion of the cage and where the arresting device will constantly adjust the configuration of its contact surface to the deformation of the stationary tube guides to provide a constant, controlled deacceleration.

It is a tertiary object of the present invention to provide a mine passenger cage safety arrester which is relatively simple and reasonable in cost and yet fully reliable in operation.

SUMMARY OF THE INVENTION

The present invention is directed primarily to mine shaft skip and passenger cage operations. Although the arrester according to the present invention could be utilized in other types of elevator operations and with other types of passenger elevator or cage guide structures it has definite advantages for use in the environment which is present in mine shaft operations. As is common, mine shaft usage provides a very adverse environment to many types of mechanical and electrical machinery. In many cases there is a considerable amount of water and high humidity present at all times along with dirt, dust, and pulverized or granulated particles from the mining operation. All of these combine to provide a very detrimental environment not only from a contamination but a corrosive viewpoint. What this essentially means is that it is difficult to provide any type of mechanical or electro-mechanical device especially for mine shaft cage and skip operations which can be expected to operate consistently and reliably under these conditions. This is especially true with arrester devices for mine shaft passenger cages wherein it is absolutely imperative that the device work promptly if an emergency situation should arise.

The present invention provides just such a solution and does it with a safety conscious stopping attitude which is highly desirable in dealing with human life.

In most mine shaft cage operations guides are provided on each side of the vertical shaft in order to guide and direct the movement of the vehicle whether it be a skip for hauling the mine products or a cage for freight or passengers. In many cases, the guides which are now being utilized are steel tubing, rectangular in cross-section which extend the entire depth of the mine shaft. Great care is taken to secure these guides to the sidewall of the shaft and to align these guides to be substantially vertical to provide a smooth operation for the mine conveyance. Although solid wood guides can be used and have been used in the past it has been found that many operations are going to the tubing guide arrangement which provides a more consistant material with minor weight considerations. What this means is that there are larger surfaces on the sides of the guide against which large rollers or wheels mounted on the top and bottom of the cage can run in contact with the sides of the guides. In this way the cage freely moves upwardly and downwardly in the mine shaft, smoothly moving along the cage guides without horizontal shifting.

Because of the rather crude structure and environment provided in the mine shaft operation, usually only two guides one on each side of the cage are provided. This is in contrast to many of the building type passenger elevators which may have as many as four or more guides to stabilize the horizontal movement of the passenger compartment during vertical travel. Although smooth vertical motion is not of paramount concern in a mine shaft cage operation, the tubing vertical guides provide a facility for a unique safety arrester.

The present invention utilizes the tubing guides as the stationary element in the arresting device with a pair of opposed cams provided on each side of the guide and on each side of the skip or passenger cage. In the present arrangement the cage is supported by a conventional box beam which is centered over the top of the passenger compartment or cage and is arranged transverse to the cage. The lifting cable is attached directly to the upper end of a draw-bar. The draw-bar is slideably mounted through the center portion of the support beam and is connected at its lower end to a pair of cross-members. The cross-members and draw-bar operate as an integral unit and are spring loaded with respect to the support beam so that the cross-members are forced downwardly away from the support beam when no supporting load is applied to the draw bar.

Two pairs of sleeve bearings, one pair mounted at each end of the support beam, are arranged to support rotatable shafts which have arrester cams mounted at their outer ends. Each pair of cams is arranged so as to straddle the sides of a guide rail. The inner ends of the arrester shafts have levers provided which are connected by adjustable links to the cross-members and the draw-bar. The cams and levers are positioned so that as long as a tension force is applied to the lifting cable by the direct weight of the skip or cage and its load, the draw-bar and cross-members will be held in a raised position in contact with the support beam. In this position, the cams will be rotated to a ready position so that they will not touch the tubing guides. If for some reason the lifting cable should break or come loose, the spring will force the cross-members and draw-bar away from the support beam causing the levers to move downward rotating the cams inwardly against the side surface of the guides.

A number of short lengths of wire rope or cable segments are secured to the outer circumferential contact surface of the arrester cams. The actuation of the arresting cams rotating inwardly on both sides of the guide rail in a self-feeding clamping motion causes the strands of cable to be forced into the sides of the guide rail causing the guides to inwardly deform. The cable segments in metal to metal contact with the surface of the guide rail cause the cables to gall producing an extremely high friction coefficient and at the same time the cables are mashed and deformed so that their outer surfaces follow the contour of the continuously deforming guide steel tubing. In this way, as the cam surfaces are fed inwardly against the guides, the configuration of the guides is followed by the also deforming surface of the cable segments so that coincidental deformation of the guides and cable cam surface constantly and progressively takes place. Thus, matching surfaces between the deforming guides and cams provide a constantly progressive force which smoothly arrests and stops the downward motion of the cage. Safety stops are provided on the rotating cams to prevent the cams from turning beyond a predetermined angular position. Thus, the dimensions of the guides and cams are designed to prevent the cams from rotating completely providing a sure and complete arresting action.

Cables fabricated from steel or other suitable soft metalic materials have been shown and described as the friction medium. Other types of materials can be utilized which can be attached to the outside surface of the braking area of the cam to provide the frictional requirements. It is important to note that it is necessary for the frictional material to be capable of deforming or changing shape in concert with the deformation of the guide tubing to provide a maximum frictional area to provide the novel cam results which are provided with the present invention.

BRIEF DESCRIPTION OF THE DRAWINGS

Other features of this invention will appear in the following description and claims, reference being made to the accompanying drawings forming a part of this specification, wherein like reference characters designate corresponding parts or portions thereof in the different views.

DETAILED DESCRIPTION OF THE DRAWINGS

Figure 1:
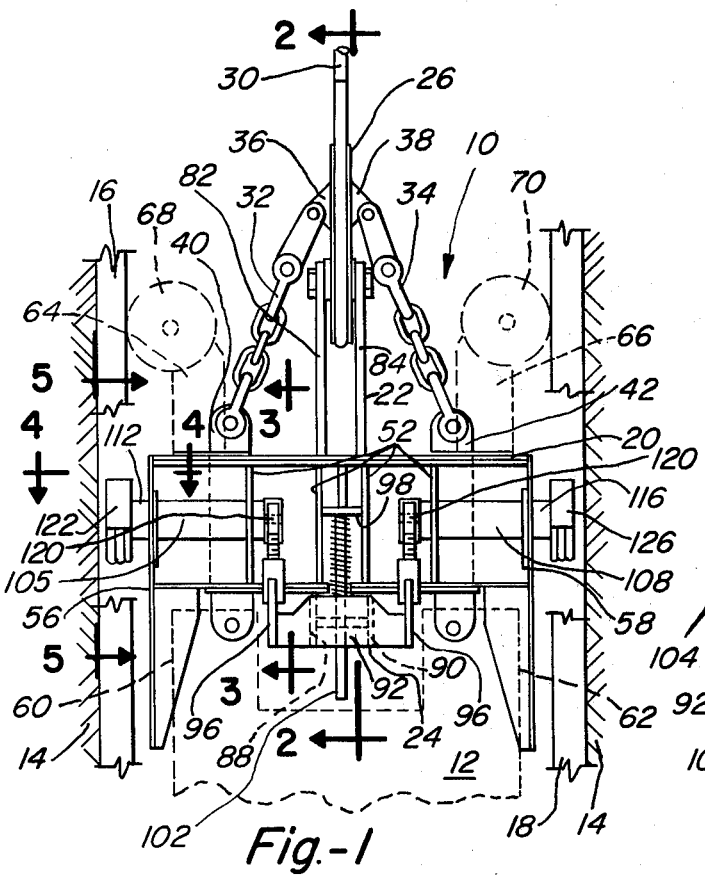
FIG. 1 is a side pictorial elevation view of the support beam and attaching structure showing the arrester device according to the present invention.
Figure 2:
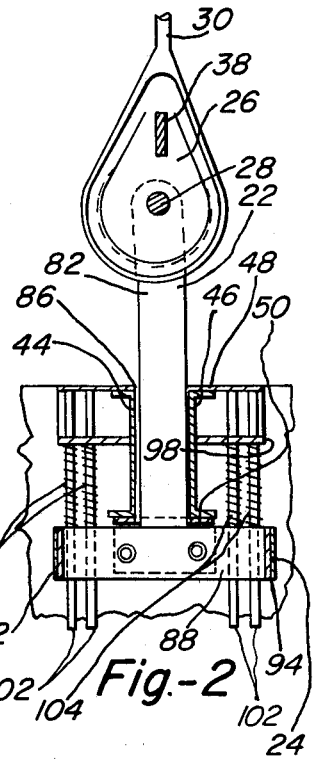
FIG. 2 is a partial cross-sectional view taken along lines 2—2 of FIG. 1 showing the lifting cable, draw-bar, and spring loaded cross-members.

Referring now more specifically to the drawings, FIG. 1 shows the support structure 10 for the mine shaft passenger cage 12. The mine shaft or passageway has sidewalls 14 and a pair of tubing guide rails 16, 18 are mounted on each sidewall 14 and aligned directly opposite to each other.

The tubing guides 16, 18 are securely attached to the sidewalls 14 by any method desired which will adequately and ridgedly support the guides in their permanent position. One way of mounting the guides to the sidewalls of the mine shaft is to secure the guide rails to spacedly arranged base plates such as by welding and bolting the base plates to the sidewall with threaded anchors. In most installations guides are utilized so as to reduce the weight which is supported on the sidewalls of the mine shaft and at the same time provide a very desirable wide surface along the sides of the guide for the guide wheels provided on the cage or conveyance.

The cage support structure 10 is made up of the transverse support beam 20, vertically slideable draw bar 22, and cross-members 24 fixedly attached to the bottom of the draw bar. The upper end of the draw bar is secured by a pin 28 to a cable thimble 26. Hoist or lifting cable 30 passes around the cable thimble 26 and is spliced or clamped so as to support the weight of the cage. A pair of safety chains 32, 34 are connected between ears 36, 38 attached to the sides of the cable thimble 26 and connecting links 40, 42 which are mounted through the support beam 20. The safety chains 32, 34 are provided as an additional safety device to prevent separation of the cable thimble from the cage.

The support beam 20 includes a pair of spacedly arranged, back-to-back channels 44, 46 which are welded to top plate 48 and bottom plate 50. This box beam configuration provides a rigid and strong support structure for the skip or cage 12. A pair of gusset plates 52, 54 are positioned on each side of the channels 44, 46 to provide reinforcement between the channels and the upper plate 48 and bottom plate 50.

The connecting links 40, 42 which are connected at their upper ends to the safety chains 32, 34 extend downwardly through the support beam 20 and are permanently welded to the structure. The bottom ends of the links 40, 42 have eyelets or apertures which are suitably connected to the cage 12 by fasteners such as bolts or pins. Stabilizing arms 64, 66 can be mounted so as to extend upwardly from the top surface of the support beam 28 and include guide wheels 68, 70 mounted at their upper ends. The guide wheels 68, 70 are arranged so that they will ride against the inwardly facing surfaces of the guide rails 16, 18. In this way the lateral movement of the support beam 20 can be stabilized and properly positioned with respect to the sides of the mine shaft and the guides. In turn, the passenger cage 12 is also stabilized against sideward movement. In addition, paris of guidewheels can also be mounted so as to extend outwardly from the stabilizing arms 64, 66 and arranged to straddle the sides of the guides 16, 18 to also stablize the support beam and cage in the transverse direction during its vertical travel in the mine shaft. It is also to be understood that additional sets of guide wheels can be provided at the bottom of the passenger cage 12 to also stablize the movement of the bottom of the cage much as the same as described for the support beam.

The structure of the draw bar 22 includes side members 82, 84 which are arranged to freely slide within a centrally positioned slot 86 provided in the support beam 20 and are connected at their upper ends to the thimble pin 28. Horizontal members 92, 94 are positioned on each side of the cross-members 88, 90 and have upwardly extending tabs 96 provided at their ends.

A spring biasing arrangement is provided for biasing the draw bar 22 and cross-member assembly 24 away from the support beam 20. Support plate 98 is provided on each side of the support beam 20 between the center gusset plates 52, 54. A plurality of elongated rods 102 are mounted through aligned aperatures in the support plate 98 and top beam plate 48 so as to extend downwardly on both sides of the support beam 20. The cross-member assembly 24 is arranged with openings to correspond with the positioning of the rods 102. A number of helical springs 104 having a rather high spring constant are positioned between the support plate 98 and the upper surface of the support member assembly 24. In this arrangement the draw bar 22 and cross-member 24 move upwardly and downwardly with respect to the support beam 20 and the rods 102 so that as the support member 24 is moved upwardly into contact with the bottom plate 50 a considerable spring biasing force is applied attempting to move the cross-members downwardly and away from the support beam 20.

As part of the arrester according to the present invention, two pairs of sleeve bearings 105, 106 and 108, and a sleeve being located directly behind 108 in FIG. 1 are arranged so that each pair is mounted at opposite ends of the support beam 20. The sleeve bearings 105, 106 and 108, 110 are fixedly mounted through aperatures provided in the end plates 56, 58 and gusset plates 52, 54. The sleeves have internal sleeves of bronze bearing material which are permanently lubricated to provide free movement for an internal shaft. Relatively large diameter shafts 112–116 and a shaft located directly behind shaft 116 in FIG. 1 are positioned within the bearings 105–110, respectively, with the center line of the shafts in each pair arranged on each side of the longitudinal axis of the support beam 20 so as to be equal distant from the respective guides 16 or 18. A lever arm 120 is attached at the ends of each shaft 112–116 and the shaft directly behind by a keyway or spined joint to make a permanent, rigid connection between the lever arm and shaft. The outer end of each lever arm 120 is arranged to extend away from the support beam 20 and is connected to the tabs 96 by means of threaded adjustable links 123.

Figure 4:
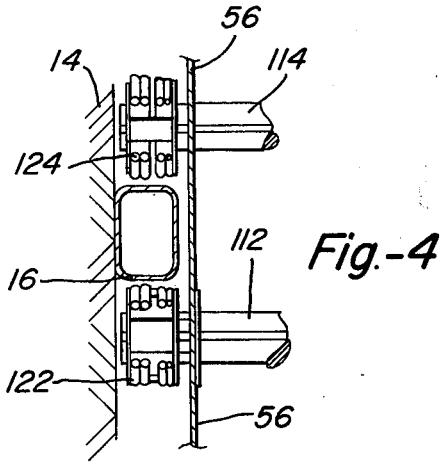
FIG. 4 is a cross-sectional view taken along lines 4—4 of FIG. 1 showing a pair of arresting cams positioned on opposite sides of tubing guides.
Figure 3:
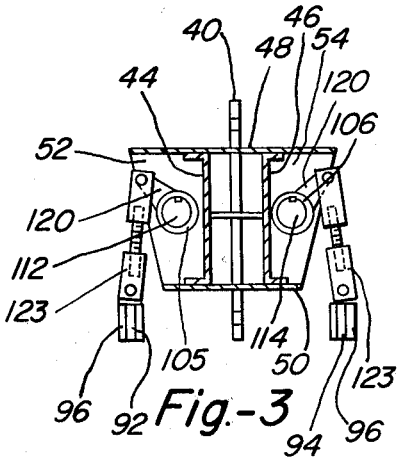
FIG. 3 is a partial cross-sectional view taken along lines 3—3 of FIG. 1 showing the cam shafts and actuating levers on each side of the support beam.
Figure 5:
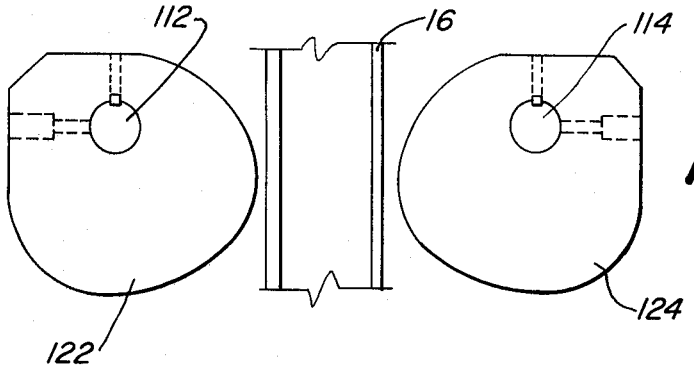
FIGS. 5, 5*a*, and 5*b* are a pictorial representation of the arresting action of the cooperating arrester cams showing the sequence of an arresting operation.
Figure 5A:
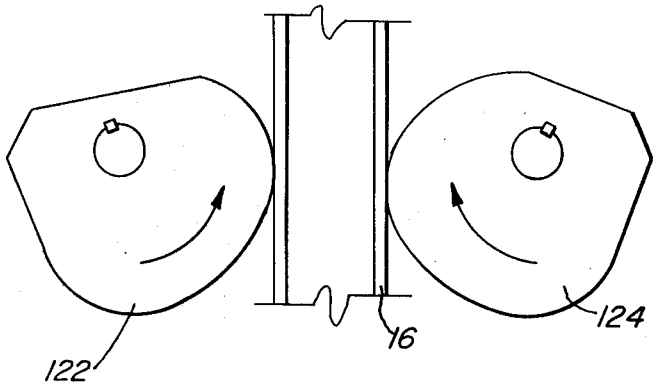
Figure 5B:
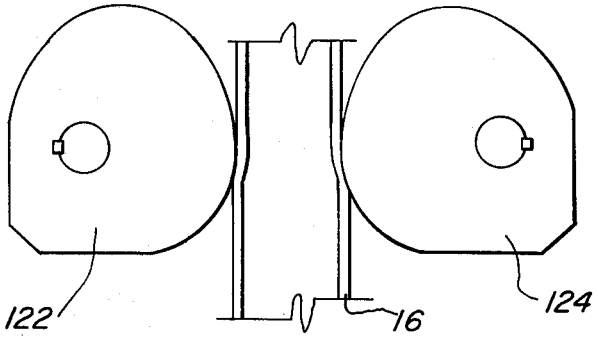

At the outer ends of shafts 112, 114, 116, and the shaft directly behind 116 are mounted arrester cams 122, 124, 126, and an arrester cam located directly behind 126 in FIG. 1, respectively. The cams on the ends of the shafts are arranged to straddle the sides of the tubing guides 16, 18. As can be seen in FIG. 4, the shafts 112, 114 are arranged equidistant on either side of the guides 16 with the cams 122, 124 arranged in their "ready" position whereby the surface of the cam is in close proximity but will not touch the guides during normal operation.

In operation the cage arrester functions in the following manner. The lifting force applied by the cable 30 causes the cable thimble 26, draw bar 22, and cross-member assembly 24 to be held in an elevated position with the cross-member assembly 24 against the bottom plate 50 of the support beam 20. In this position the biasing springs 104 are held in a compressed condition creating a considerable biasing force attempting to move the cross-member assembly 24 and draw works downwardly and away from the bottom of the support beam 20. At all times while the hoisting cable is supporting the weight of the structure 10 and passenger cage 12 the draw bar 22 and cross-member assembly 24 are held in the "ready" position. If the hoist cable 30 should separate or break releasing the entire load, the cross-member assembly 24 will move downwardly away from the support beam 20 in response to the biasing force of the springs 104. This movement will cause the adjustable links 123 to move downwardly causing the lever arms 120 to rotate outwardly away from the beam causing the cams 122, 124, 126, and the cam directly behind 126 to rotate inwardly to contact the hollow guides 16, 18.

The arrester cams working in concert and in counter-rotational movement cause the cam contact surfaces to move against the sides of the tubing guides producing contact friction and drawing the cams inwardly in a continuous counter-rotating motion until the maximum radial dimension of the cam has been reached if needed. At this point stops are provided on the outer surfaces of the end plates 56, 58 preventing the cams from rotating further which would allow the braking force to be released. The counter-rotation of the cams on each side of the guides causes a clamping and crushing force to be applied to the guides producing considerable stress which causes a progressive deformation of the guides and consequently stopping the freefall motion of the cage.

Figure 6:
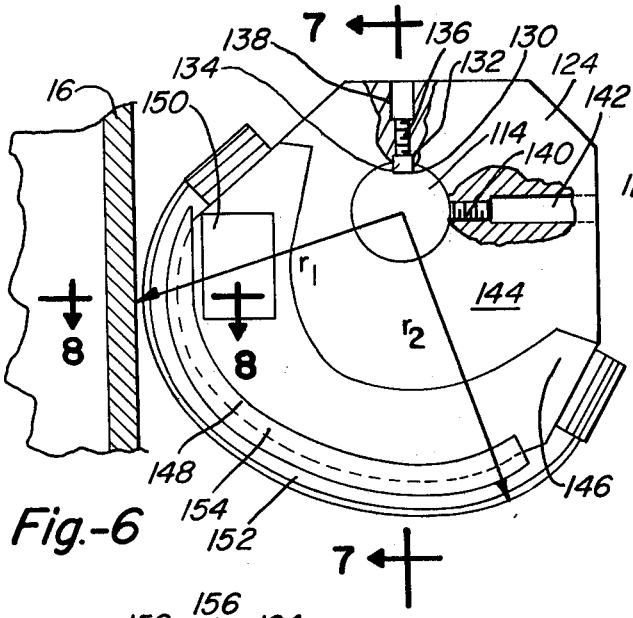
FIG. 6 shows a side view of an arresting cam in the ready position with respect to the partially cut away sidewall of the guide showing the cable segments arranged around the circumferential braking surface of the cam.
Figure 7:
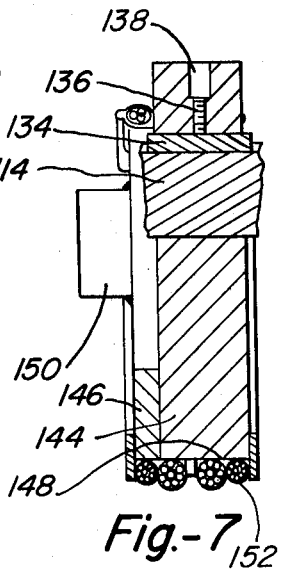
FIG. 7 shows a cross-section of the cam taken along the lines 7—7 of FIG. 6 showing the key and set-screw arrangement for rigidly connecting the arresting cam to the shaft.

FIG. 6 shows a typical arrester cam 124 in the "ready" position with respect to the tube guides 16. Throughout the remainder of this description, it is to be understood that the illustration of cam 124 is typical for all of the arrester cams which are considered part of this invention. The only difference is that the individual cams are reversed so that both cams in each pair will inherently counter-rotate and feed inwardly against the opposite sides of the guides.

To securely attach the cam 124 to the shaft 114, a keyway slot 130 is provided. A key 134 is inserted within the aligned keyway slot 130 to prevent any possible rotation of the cam 124 with respect to the shaft 114. A set screw 136 is inserted into the threaded counterbore 138 to prevent movement or dislodgement of the key 134. As a backup safety feature a redundant set screw 140 may be provided in a threaded counterbore 142 which is positioned at right angles to the first set screw 136 to provide an additional locking force on the shaft 114. It is possible to substitute a splined connection between the shaft 114 and 124 or any other type of shaft connection which will prevent any possible rotation of the cam with respect to the shaft.

Depending upon the width of the cam surface required for the particular arrester installation, an extension support plate 146 can be added to the side surface of the cam body 144. The addition of the extension 146 may also be required if the offset configuration for the cam is desired. The offset arrangement will be explained below.

The cam contact surface 148 which is utilized for braking purposes has a continuously increasing radius from the shaft center line which increases from radius $r_1$ to $r_2$. The radius increase is greatest in the first 20 degrees of rotational movement which quickly moves the cam surface from the "ready"position into actual contact with the guide rail with a very short rotational movement. The initial rotational movement of the cam will place the contact point in a plane which is nearly perpendicular with the surface of the guides causing the greatest direct application of leverage galling and braking forces. The cam braking surface is designed so that the maximum radius point is approximately 90 degrees from the initial contact point. Thus, after the cam has rotated approximately 90 degrees it produces the maximum force possible in the arrester operation.

Figure 8:
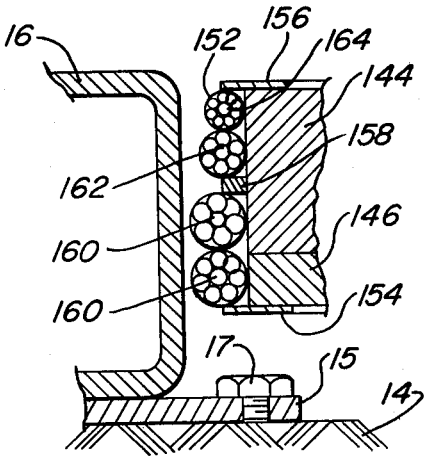
FIG. 8 shows a cross-section taken along the lines 8—8 of FIG. 6 showing the cam in the ready position with respect to the surface of the tubing guides.
Figure 9:
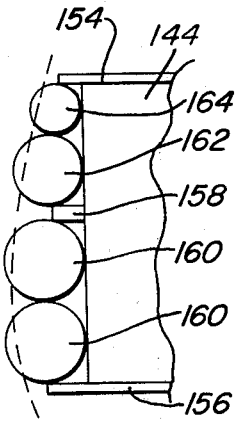
FIG. 9 is a pictorial presentation of the cable arrangement on the outer surface of the cam showing the larger diameter cables arranged on one side of the cam in an offset arrangement; and, FIG. 9*a* is a pictorial presentation of the cable arrangement on the outer surface of the cam showing the cables in a symetrical arrangement for operating in alignment with the center line of the guides.

In the present invention it is desirable to use a material on the surface of the braking cam which will produce an extremely high friction coefficient and yet will deform continuously and progressively with the deformation of the tubing guides surfaces. It has been found that segments of steel cable or wire rope performs this function. The length of the cable segments is selected to extend beyond the actual cam braking surface 148. To provide a secure attachment of the cable, soft steel sleeves are swaged to each end of the cable segments and the swaged sleeves are brased and the assembly welded to the surface of the cam. The cable segments as shown in FIGS. 8 and 9 are arranged in parallel positions following the cam braking contact surface 148. Side fences 154, 156 and a center spacer 158 are arranged around the edges and along the middle respectively of the cam surface 148 to securely retain the cable segments 152 in proper alignment and position.

The diameter of the cable segments can be arranged across the face of the cam with the larger diameter cables positioned to coincide with the area of the guides 116 which is expected to have the greatest lateral deformation. Various combinations of cable diameters can be provided depending upon the material used in the fabrication of the tubing guides and the strength of this material which determines its rate of deformation with the application of the braking force. In FIG. 8, the offset arrangement is shown whereby the centerlines of the guides and the braking cam are offset. In the offset relationship, the largest cables 160 which coincide and are concentric with the centerline of the guides 16 can be of approximately $\frac{3}{4}$ inch diameter. The next adjacent cable 162 can have a diameter of approximately $\frac{5}{8}$ of an inch while the outer cable 164 has a diameter of approximately $\frac{1}{2}$ inch.

The offset arrangement as described herein is necessitated by the fact that the position of the braking cams 124–128 must be spaced away from the mounting plates 15 and fasteners 17 which retain the guides 16 on the sidewalls 14 of the mine shaft. To prevent contact of any of the cams with the sides of the mine shaft, it is necessary that the centerline of the cam and guides be offset as explained above.

Once actuated the counter rotation of the pairs of cams on each side of the guides cause the cables to come in contact with the side surfaces of the guides with a steady and continuously increasing force applied to both sides of the guides as the cam surfaces make contact and are rotated so as to feed the ever increasing radius of the cams into the surface of the guide. This continuous feeding and galling braking process on each side of the guide rail causes an increased force to be applied causing the cable surfaces to mash so as to conform with the surface of the side of the guides increasing the contact area along with the frictional forces applied. The contact of the cables against the guides causes a galling and erosion effect to take place with the cable material producing an extremely high coefficient of friction. This continuous galling of the guides and cable surfaces forms a profile surface following the lateral deformation of the guides as additional force is applied. Thus, the surface of the braking material is continuously changing so as to follow the deformation of the guides producing a reliable braking action.

Steel cable has proven to be one of the few materials that has been found which provides a reliable braking surface which follows the contour of the deforming guides during the braking operation. It is to be understood that any braking material which is utilized for this purpose must be pliable to produce the changing contour and yet produce an extremely high coefficient of friction to provide the stopping force which is necessary to catch and suspend the freefalling passenger cage.

Figure 8A:
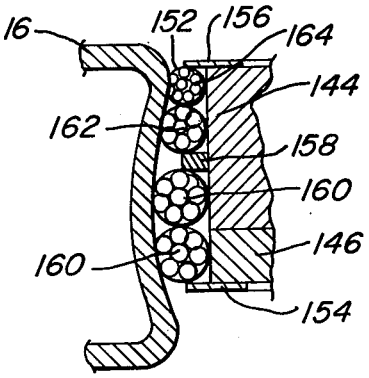
FIG. 8*a* shows the cross-section of the cam surface in contact with the tubing guides during arresting operation.
Figure 9A:
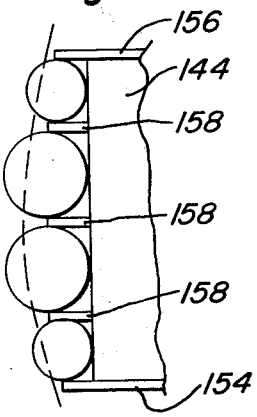

FIG. 9 shows the offset cable segment arrangement which is described in FIGS. 8 and 8*a* with a dotted line showing the galling contour which is experienced by the cable during actual braking operation. The cable arrangement in FIG. 9*a* shows the two larger diameter cables in the center with smaller diameter cables on each side. This arrangement is usually provided where there is coaxial alignment between the centerline of the guide rail and the cam whereby a concentric contact profile is possible.

With the cable diameter sizes as described hereinabove, it is anticipated that the braking cams can have a width of approximately 2½ to 3 inches with usually four cable segments arranged across the cam braking surface. Considerably larger braking cams can be provided depending upon the size and weight of the conveyance on which the braking device is installed. Larger or smaller diameter cables can be provided as desired to provide the necessary contact surface.

It is to be understood that this novel mine shaft skip and cage arresting device can be utilized in any shaft which is vertical or inclined and which experiences the detrimental environmental conditions which are usually associated with this type of mine operation. Conventional structural materials for the environmental conditions anticipated can be selected. As described herein steel cable or wire rope has been found to produce the desired braking results. It is to be understood, however, that any type of braking material which produces the necessary surface contour changes and yet produces the necessary high friction characteristics can be utilized.

While a new and novel mine cage arrester device has been shown and described in detail, it is obvious that this invention is not to be considered to be limited to the exact form disclosed and changes and variations in detail and construction of the various embodiments may be made herein within the scope of the invention without departing from the spirit thereof.

We claim the following:

1. A mine shaft cage and skip safety arrester for use with tubing guides, the arrester comprising:

(a) a conveyance body supported by a lifting cable and arranged to move within a mine shaft, said conveyance body includes a support beam arranged transverse to the conveyance body and to support the weight of said body, said mine shaft having at least two tubing guides mounted longitudinally on opposite sides of said shaft and arranged to stabilize the motion of said conveyance body;

(b) two pairs of arrester cams rotatably mounted on said support beam, each pair of said arrester cams being arranged at opposite ends of said support beam and aligned to straddle each of said guides;

(c) actuation means arranged to rotate the shafts supporting said arrester cams in a self-feeding, counter-rotation direction against the sides of said guides, said actuation means further including a drawbar arranged to slideably move through the center of said support beam and having one end attached to said lifting cable, the opposite end of said drawbar being attached to cross members arranged transverse to said support beam and located in a first position in contact with said support beam when said lifting cable supports the weight of said conveyance body spring means positioned to act on said cross member to move said cross members to a second position if said lifting cable should fail, said cross-members being connected to means for rotating said cams whereby said arrester cams will normally be held in a ready position when said support members are held in said first position to an arresting position when said support member moves to said second position; and, (d) each of said arrester cams having a plurality of steel cable segments arranged in parallel position around the circumference of the cam contact surface, said cables being ridgedly attached to the surface of said cam whereby as the cam is rotated to the arresting position the cables will contact the surface of said guides with continuously increasing braking force whereby the surface of said cables will gall upon contact with said guides creating an extremely high co-efficient of friction and deform the tubing continuously following the deformation of said guides producing a maximum area braking surface for decelerating and stopping the falling motion of said conveyance body.

2. A mine shaft cage and skip safety arrester for use with guides, the arrester comprising:

a. a conveyance body supported by a hoist cable and arranged to move within a mine shaft; said mine shaft having guides mounted longitudinally on opposed sides of the shaft and arranged to stabilize the motion of the body, each of said guides comprising a hollow elongated member formed from a material which will continually deform as an increasing force is applied thereto;

b. at least one pair of arrester cams rotatably mounted on said body, said cams being arranged to straddle the sides of the guides;

c. actuation means connected to said arrester cams and arranged to rotate said cams in a self-feeding, counter-rotating direction against the sides of the guides if said hoisting cable should fail to support the weight of the body;

d. each of said cams having a cam braking surface which as said cam is rotated in contact with said guide will produce an increasingly greater galling and deforming braking force on said guides, said cam braking surface being a deformable, high friction braking material which will continuously deform during the braking operation so as to follow the lateral deformation produced in the sidewall of the guides to provide a maximum braking surface for smooth deceleration and stopping the falling motion of the body; and e. said braking operation comprising a surface to surface contact with no penetration of either surface and a continuing increase in the surface area of contact.

3. A mine cage and skip safety arrester as defined in claim 2 wherein the arrester cams include a stop provided on the side surface of the cam, said stop being positioned to contact a stationary member on the conveyance body to prevent the cam from rotating past a maximum stopping force position on said cam surface.

4. A mine cage and skip safety arrester as defined in claim 1 wherein said actuation means includes an integral support member assembly and drawbar slideably positioned through a support means for said mine hoist body, said lifting cable being attached to the upper end of said drawbar and the cross-member assembly being arranged to support the conveyance body, a biasing means being positioned between a fixed support means and said cross-member assembly whereby if the lifting cable should fail, the cross-member assembly will be moved from a ready position to an arresting position whereby the cams are rotated by the biasing means into braking contact with the guides.

5. A mine cage and skip safety arrester as defined in claim 4 wherein said actuation means further includes adjustable connecting means between the said cross-member assembly and said cam rotating means whereby the position of the cam surface with respect to the guides can be adjusted whereby a minimum angular rotation of the cams is necessary to effect the braking contact of the cams against the guides.

6. A mine cage and skip safety arrester as defined in claim 2 wherein the braking material on each cam surface is a plurality of parallel arranged segments of steel cable.

7. A mine cage and skip safety arrester as defined in claim 6 wherein said steel cable segments are of a length which extends past said cam braking surface and has swaged sleeves mounted on each end, said sleeves being permanently attached to the cam to ridgedly hold the cable segments in aligned parallel position for the braking surface.

8. A mine cage and skip safety arrester as defined in claim 6 wherein four cable segments are provided, two of said cable segments having a larger diameter than the remaining two segments and the larger diameter cable segments being positioned opposite the center area of the guides which will be contacted by the arrester cam surface.

9. A mine cage and skip safety arrester as defined in claim 6 wherein one or more of the cable segments have different cross-sectional diameters with the larger diameter segments arranged nearest the center area of the guides.

10. A mine cage and skip safety arrester as defined in claim 9 wherein the centerline of the cams and the guides coincide and the cable segments on either side of the cam centerline are of a larger diameter than the other cable segments.

11. A mine cage and skip safety arrester as defined in claim 9 wherein the centerline of the cam and the guides are offset one from the other and the cable segments opposite the centerline of the guides are of a larger diameter than the other cable segments.

* * * * *

UNITED STATES PATENT AND TRADEMARK OFFICE

CERTIFICATE OF CORRECTION

PATENT NO. : 4,444,293

DATED : April 24, 1984

INVENTOR(S) : Willard S. Paul, Gary K. Christian

It is certified that error appears in the above—identified patent and that said Letters Patent is hereby corrected as shown below:

In the Detailed Description of the Drawings, Column 5, Line 59, "paris" should read --pairs--. In the Claims, Claim 4, Line 2, delete "1" and insert --2--.

Signed and Sealed this

*Fourteenth* Day of *August 1984*

[SEAL]

*Attest:*

GERALD J. MOSSINGHOFF

*Attesting Officer*

*Commissioner of Patents and Trademarks*